US005601696A

United States Patent [19]

Asakawa

[11] Patent Number: 5,601,696

[45] Date of Patent: Feb. 11, 1997

[54] SILVER PLATING BATHS AND SILVER PLATING METHOD USING THE SAME

[75] Inventor: Takanobu Asakawa, Hiratsuka, Japan

[73] Assignee: Electroplating Engineers of Japan Limited, Tokyo, Japan

[21] Appl. No.: 538,602

[22] Filed: Oct. 3, 1995

[30] Foreign Application Priority Data

Oct. 4, 1994 [JP] Japan ..... 240288

[51] Int. Cl.[6] ..... C25D 3/46; C23C 16/00; C23C 18/00

[52] U.S. Cl. ..... 205/263; 106/123; 106/126

[58] Field of Search ..... 205/238, 242, 205/263; 106/1.23, 1.26

[56] References Cited

U.S. PATENT DOCUMENTS

| | | | |
|---|---|---|---|
| 3,018,232 | 6/1958 | Bishoff et al. | 205/263 |
| 4,246,077 | 1/1981 | Hradil et al. | 205/238 |
| 4,399,006 | 8/1983 | Nobel et al. | 205/263 |

FOREIGN PATENT DOCUMENTS

| | | | |
|---|---|---|---|
| 527335 | 1/1977 | Japan | C25D 3/46 |
| 54-39329 | 3/1979 | Japan | C25D 3/46 |
| 54-155132 | 12/1979 | Japan | C25D 3/46 |
| 59-150095 | 8/1984 | Japan | C25D 3/46 |
| 2290993 | 11/1990 | Japan | C25D 3/46 |
| 7166391 | 6/1995 | Japan | C25D 3/46 |

OTHER PUBLICATIONS

Promsiel et al., "Silver Plating", The Electrochem. Soc., Preprint 80–35, pp. 473–498. Oct. 1941.

Article entitled "Development of Cyanide–Free Silver Plating Bath" by Hiroyuki Inoue et al., College of Eng., University of Osaka, Japan (no date).

Article entitled "Effect of Additives on High Brightness Non–Cyanide Silver Electroplate" by Yongkang Ji, et al. Fac. of Eng. Nagoya University, Japan (no date).

Article entitled "Glossy Silver Electrodeposition from Non–Cyanide Bath" by Seishi Masaki et al. (no date).

H. Wachi, "Method and bath for cyanide–free silver electroplating", Chemical Abstracts, Oct. 16, 1995, p. 893 (and 1).

T. Asakawa, "Cyanide–free silver plating bath and plating method", Chemical Abstracts, Apr. 17, 1995, p. 882 (and 1).

M. J. Blaise et al., "Metallic complexation of imides. II. Thermodynamic values of the formation of silver(I), cadmium(II), cobalt(II), nickel(II), copper(II), and zinc(II) with hydantoin", Chemical Abstracts, Jun. 11, 1979, p. 431 (and 1).

*Primary Examiner*—Kathryn Gorgos
*Assistant Examiner*—Edna Wong
*Attorney, Agent, or Firm*—Michael D. Bednarek; Kilpatrick & Cody

[57] ABSTRACT

An object is to provide practical silver plating technique, high-speed silver plating technique and silver strike plating technique which have, respectively, substantially the same performance as cyanide baths without use of any toxic cyanide. A hydantoin compound of the following general formula is contained as a complex-forming agent

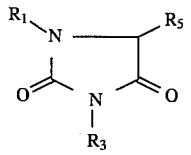

[wherein $R_1$, $R_3$ and $R_5$ independently represent hydrogen, an alkyl group having 1–5 carbon atoms, an aryl group or an alcohol].

15 Claims, No Drawings

SILVER PLATING BATHS AND SILVER PLATING METHOD USING THE SAME

BACKGROUND OF THE INVENTION

1. Field of the Invention

This invention relates to a silver plating technique, a high-speed silver plating technique and a silver strike plating technique and more particularly, to silver plating techniques which do not use any toxic cyanide.

2. Description of the Prior Art

Silver plating has been conventionally used for decoration and for dinner wares. Owing to its excellent electric characteristics, silver plating has wide utility in the field of the electronic industry as a material such as for switches, connectors and the like.

In the currently employed, practical silver plating baths, strongly toxic cyanide compounds are used in most cases accompanied by problems on safety operation or treatment of waste water. To avoid the problems, attempts have been made to use silver plating baths which are free of any cyanide compound, e.g. a silver nitrate-thiourea bath and a silver iodide-organic acid bath. Other types of baths have been proposed including a bath wherein triethanolamine is added to silver thiocyanate (Japanese Laid-open Patent Application No. Sho 54-155132) and a bath wherein sulfanilic acid derivatives and potassium iodide are added to inorganic or organic acid salts of silver (Japanese Laid-open Patent Application No. Hei 2-290993).

The silver plating baths using no cyanide compound impose less serious problems on toxicity and treatment of waste water on comparison with silver plating baths using cyanide compounds. However, when such silver plating baths are industrially used in practical applications, most of the baths are not satisfactory and there is some room for improvements particularly with respect to bath stability, uniformity in electrodeposition, critical current density, physical properties of deposit, and appearance. Especially, the baths have not been suitable for practical use in high-speed plating or strike plating. For instance, where silver strike plating is effected on a base metal matrix such as copper, nickel, or alloys thereof, the adhesion between the plated film and the matrix is not so good when using such a conventional non-cyanide plating bath as set out hereinabove. In addition, the solution is decomposed during use and the silver is liable to be reduced, with the tendency that the life of the bath becomes shortened.

The invention has been made to overcome the problems involved in these prior art techniques and has for its object a provision of a practical silver plating technique, a high-speed silver plating technique and a silver strike plating technique which have, respectively, such a performance as cyanide baths without use of any toxic cyanide.

SUMMARY OF THE INVENTION

In order to achieve the above object, the invention contemplates to provide a silver plating bath which comprises an organic acid salt of silver used as a silver compound, at least one of hydantoin compounds of the following general formulas used as a complex-forming agent

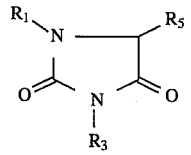

[wherein $R_1$, $R_3$ and $R_5$ independently represent hydrogen, an alkyl group having 1–5 carbon atoms, an aryl group or an alcohol], and

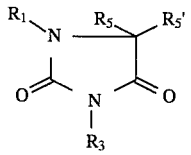

[wherein $R_1$, $R_3$, $R_5$ and $r_5'$ independently represent hydrogen, an alkyl group having 1–5 carbon atoms, an aryl group or an alcohol], and at least one of a salt of an inorganic acid and a carboxylate as a conductive salt. Further, the silver plating bath may further comprise, as a gloss controlling agent, at least one of an organic sulfur compound having a SH group or carboxyl group, an S-containing amino acid and sulfite ions. The silver bath has such a bath composition that silver is contained in an amount of 1–100 g/l as a metal concentration, a complex-forming agent is contained in an amount of $10^{-15}$–$10^{-2}$ mol/l as a concentration of silver ions in the bath, and the conductive salt is contained in an amount of 1–100 g/l. In addition, the silver plating bath should preferably be used under working conditions of a pH of 8–13, a liquid temperature of 30°–90° C. and a current density of 1–20 A/dm$^2$.

The invention also provides a high-speed silver plating bath consisting of the above bath composition. The high-speed silver plating bath comprises 1–150 g/l of silver as a metal concentration, $10^{-15}$–$10^{-2}$ mol/l of the complex-forming agent as a concentration of silver ions in the bath, and 1–100 g/l of the conductive salt. This high-speed silver plating bath is used under working conditions of a pH of 8–13, a liquid temperature of 30°–90° C. and a current density of 10–150 A/dm$^2$.

The invention further provides a silver strike plating bath consisting of the afore-stated bath composition. The silver strike plating bath comprises 0.1–5 g/l of silver as a metal concentration, $10^{-15}$–$10^{-2}$ mol/l of the complex-forming agent as a concentration of silver ions in the bath, and 1–100 g/l of the conductive salt. The silver strike plating bath is used under working conditions of a pH of 7–13, a liquid temperature of 20°–90° C. and a current density of 1–20 A/dm$^2$ or a voltage of 1–20 V.

The silver plating bath, high-speed plating bath and strike plating bath are described in more detail. The term "high-speed" used herein is intended to mean that at least a current density of not lower than 10 A/dm$^2$ is enabled, a plating speed is not lower than 330 μm/hour, and the deposit obtained under these conditions has no crack observed therein.

The inorganic acid salts of silver used as a silver compound include silver nitrate, silver oxide and the like. The complex-forming agents include, for example 1-methylhydantoin, 1,3-dimethylhydantoin, 5,5-dimethylhydantoin, 1-methanol-5,5-dimethylhydantoin, 5,5-diphenylhydantoin and the like. The conductive salts include, for example, inorganic salts such as potassium chloride, potassium formate and the like, and carboxylates.

The silver plating bath may further comprise, as a gloss controlling agent, at least one of an organic sulfur compound having a SH group or carboxyl group, an S-containing amino acid and sulfite ions. The gloss controlling agents include, for example, thiosalicylic acid, thiamine hydrochloride, thiamine nitrate, potassium sulfite and the like. The amount is in the range of 0.1–100 g/l, preferably 0.1–50 g/l, and more preferably 0.5–10 g/l. The reason why the amount is defined in the range of 0.1–100 g/l is that when it is less than 0.1 g/l, any significant effect of the gloss controlling agent cannot be expected and that if the amount exceeds 100 g/l, deposition is adversely influenced. The silver concentrations in the silver plating bath, high-speed plating bath and silver strike plating bath are, respectively, within the ranges of concentration defined above. More preferably, the following amounts are used. The amount of silver is preferably in the range of 5–50 g/l, more preferably 8–30 g/l, for the silver plating bath, is preferably in the range of 30–100 g/l, more preferably 40–80 g/l, for the high-speed plating bath, and is preferably in the range of 0.3–3 g/l, more preferably 0.5–1.5 g/l, for the silver strike plating bath.

In the respective plating baths, if the silver concentrations are, respectively, lower than such lower limits as set out above, the resultant deposit suffers an adverse influence on its appearance and the upper limit of the current density becomes smaller, making it difficult to be practically applied. On the contrary, the silver concentrations in the respective plating baths above the upper limits necessitate larger amounts of a complex-forming agent depending on the amount of silver. Accordingly, the complex-forming agent is liable to be saturated and becomes less soluble, thus leading to higher costs and being not suited for practical use.

The reasons why the amounts of the complex-forming agent and the conductive salt in the silver plating bath, high-speed plating bath and strike plating bath are, respectively, defined within the ranges described above are set out below. If the silver ion concentration is less than $10^{-15}$ mol/l any silver is not deposited. On the contrary, when the concentration exceeds $10^{-2}$ mol/l an amount of deposit becomes extremely small. If the conductive salt is present in amounts less than 1 g/l or greater than 100 g/l, a good appearance is difficult to obtain, with another difficulty in stabilizing the pH in the bath and imparting appropriate conductivity to the bath.

The working conditions in the silver plating bath, high-speed plating bath and silver strike plating bath of the invention are described below.

The reason why the pH is defined in the range of 8–13 for the silver plating bath and high-speed silver plating bath and in the range of 7–13 for the silver strike plating bath is that if the pH is lower than 8 or 7, there is a possibility that a silver salt settles in the bath, with the deposition efficiency lowering extremely. If the pH is higher than 13, a deposit having a good appearance is difficult to obtain. The pH is usually adjusted by use of potassium hydroxide, sodium hydroxide, sulfuric acid or the like.

The liquid temperature of the silver plating bath and high-speed silver bath is in the range of 30°–90° C. and that of the silver strike plating bath is in the range of 20°–90° C. This is because if the temperature is lower than 30° C. or 20° C., the resultant deposit does not exhibit a good appearance. Over 90° C., the baths becomes unstable.

The current density is in the range of 1–20 A/dm$^2$ for the silver plating bath and silver strike plating bath and in the range of 10–150 A/dm$^2$ for the high-speed silver plating bath. This is because if the current density is lower than 1 A/dm$^2$ or 10 A/dm$^2$, the deposition rate is so low that a deposit having a satisfactory thickness of plating is difficult to obtain. On the contrary, when the current density exceeds 20 A/dm$^2$ or 150 A/dm$^2$, a good appearance can not be attained and hydrogen generates to extremely reduce the amount of deposit.

The silver strike plating bath of the invention can be worked by application of a voltage. This voltage is defined in the range of 1–20 V. This is for the same reason as in the case where the current density is defined in the range of 1–20 A/dm$^2$. When the strike plating is effected while the voltage is varied within the above-defined range, the resultant film has excellent uniformity of electrodeposition and an excellent surface smoothness. In the respective plating baths of the invention, the current density can be increased in proportion to the liquid temperature and the silver concentration.

Compositions and conditions in the silver plating bath and a silver plating method using the same according to the present invention can be combined as [A] through [M] as itemized below.

[A] A silver plating bath which comprises an inorganic acid salt of silver used as a silver compound, at least one of hydantoin compounds of the following general formulas used as a complex-forming agent

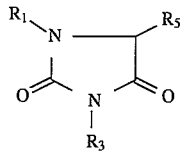

[wherein $R_1$, $R_3$ and $R_5$ independently represent hydrogen, an alkyl group having 1–5 carbon atoms, an aryl group or an alcohol], and

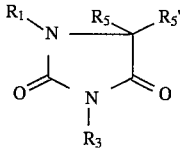

[wherein $R_1$, $R_3$, $R_5$ and $R_5'$ independently represent hydrogen, an alkyl group having 1–5 carbon atoms, an aryl group or an alcohol], and at least one of a salt of an inorganic acid and a carboxylate as a conductive salt.

[B] The silver plating bath according to [A], wherein the inorganic acid salts of silver used as a silver compound is silver nitrate and/or silver oxide.

[C] The silver plating bath according to [A] or [B], wherein the complex-forming agents is at least any one of 1-methylhydantoin, 1,3-dimethylhydantoin, 5,5-dimethylhydantoin, 1-methanol-5,5-dimethylhydantoin, 5,5-diphenylhydantoin.

[D] The silver plating bath according to any of [A] to [C], wherein at least one of an organic sulfur compound having a SH group or a carboxyl group, a S-containing amino acid, or sulfite ions is introduced as a gloss controlling agent.

[E] The silver plating bath according to any of [A] to [D], wherein potassium chloride and/or potassium formate is introduced as conductive salts.

[F] The silver plating bath according to any of [A] to [E], wherein silver is contained in an amount of 1–100 g/l as a metal concentration, the complex-forming agent is contained in an amount of $10^{-15}$–$10^{-2}$ mol/l as a concentration of silver ions in the bath, and the conductive salt is contained in an amount of 1–100 g/l.

[G] A silver plating method wherein the silver plating bath according to [A] to [F] is employed under operating conditions of a pH of 8–13, a liquid temperature of 30°–90° C. and a current density of 1–20 A/dm$^2$.

[H] A high-speed silver plating bath consisting of a bath composition according to any of [A] to [E].

[I] The high-speed silver plating bath according to [H], wherein silver is contained in an amount of 1–150 g/l as a metal concentration, the complex-forming agent is contained in an amount of $10^{-15}$–$10^{-2}$ mol/l as a concentration of silver ions in the bath, and the conductive salt is contained in an amount of 1–100 g/l.

[J] The high-speed silver plating method wherein the high-speed silver plating bath according to [H] or [I] is employed under operating conditions of a pH of 8–13, a liquid temperature of 30°–90° C. and a current density of 10–150 A/dm$^2$.

[K] The silver strike plating bath consisting of the bath composition according to any of [A] to [E].

[L] The silver strike plating bath according to [K], wherein silver is contained in an amount of 0.1–5 g/l as a metal concentration, and the complex-forming agent is contained in an amount of $10^{-15}$–$10^{-2}$ mol/l as a concentration of silver ions in the bath, and said conductive salt is contained in a amount of 1–100 g/l.

[M] The silver strike plating method wherein the silver strike plating bath according to [K] or [L] is employed under operating conditions of a pH of 7–13, a liquid temperature of 20°–90° C. and a current density of 1–20 A/dm$^2$ or a voltage of 1–20 V.

It should be noted that the content of the invention is not limited to the above description, and the objects, advantages, features, and usages will become more apparent according to descriptions below. It is also to be understood that any appropriate changes without departing from the spirit of the invention are in the scope of the invention.

DETAILED DESCRIPTION OF THE PREFERRED EMBODIMENTS

The invention is described in more detail with reference to embodiments hereinafter.

Example 1

| | |
|---|---|
| Silver nitrate | 16 g/l |
| Hydantoin | 40 g/l |
| Potassium chloride | 8 g/l |
| pH | 9.5 |
| Liquid temperature | 40° C. |
| Current density | 1 A/dm$^2$ |

A copper test piece was subjected to silver plating using the above bath composition and working conditions, thereby obtaining a deposit having a film thickness of 3.5 μm and a dull appearance. The current efficiency was 100% and the plating speed was 38 μm/hour. The bath was usable by three turns.

Example 2

| | |
|---|---|
| Silver oxide | 11 g/l |
| Hydantoin | 40 g/l |
| Potassium chloride | 8 g/l |
| pH | 9.0 |
| Liquid temperature | 45° C. |
| Current density | 1 A/dm$^2$ |

A copper test piece was subjected to silver plating using the above bath composition and working conditions, thereby obtaining a deposit having a film thickness of 3.5 μm and a dull appearance. The current efficiency was 100% and the plating speed was 38 μm/hour. The bath was usable by three turns.

Example 3

| | |
|---|---|
| Silver nitrate | 16 g/l |
| Dimethylhydantoin | 50 g/l |
| Sodium chloride | 10 g/l |
| pH | 9.5 |
| Liquid temperature | 50° C. |
| Current density | 1 A/dm$^2$ |

A copper test piece was subjected to silver plating using the above bath composition and working conditions, thereby obtaining a deposit having a film thickness of 3.5 μm and a dull appearance. The current efficiency was 100% and the plating speed was 38 μm/hour. The bath was usable by three turns.

Example 4

| | |
|---|---|
| Silver nitrate | 16 g/l |
| 1-methanol-5,5-dimethylhydantoin | 60 g/l |
| Potassium chloride | 8 g/l |
| pH | 10 |
| Liquid temperature | 55° C. |
| Current density | 1 A/dm$^2$ |

A copper test piece was subjected to silver plating using the above bath composition and working conditions, thereby obtaining a deposit having a film thickness of 3.5 μm and a dull appearance. The current efficiency was 100% and the plating speed was 38 μm/hour. The bath was usable by three turns.

Example 5

| | |
|---|---|
| Silver nitrate | 16 g/l |
| Dimethylhydantoin | 50 g/l |
| Potassium chloride | 8 g/l |
| Thiosalicyclic acid | 1 g/l |
| pH | 9.5 |
| Liquid temperature | 50° C. |
| Current density | 1 A/dm$^2$ |

A copper-test piece was subjected to silver plating using the above bath composition and working conditions, thereby obtaining a deposit having a film thickness of 3.5 μm and a glossy appearance. The current efficiency was 100% and the plating speed was 38 μm/hour. The bath was usable by three turns.

Example 6

| | |
|---|---|
| Silver nitrate | 16 g/l |
| Dimethylhydantoin | 50 g/l |
| Potassium chloride | 10 g/l |
| Thiamine hydrochloride | 0.5 g/l |
| pH | 9.5 |
| Liquid temperature | 50° C. |
| Current density | 1 A/dm$^2$ |

A copper test piece was subjected to silver plating using the above bath composition and working conditions, thereby obtaining a deposit having a film thickness of 3.5 μm and a glossy appearance. The current efficiency was 100% and the plating speed was 38 μm/hour. The bath was usable by three turns.

Example 7

| | |
|---|---|
| Silver nitrate | 64 g/l |
| Hydantoin | 130 g/l |
| Potassium chloride | 30 g/l |
| pH | 9.5 |
| Liquid temperature | 70° C. |
| Current density | 30 A/dm$^2$ |

A copper test piece was subjected to high-speed silver plating using the above bath composition and working conditions, thereby obtaining a deposit having a film thickness of 5 μm and a dull appearance. The current efficiency was 100% and the plating speed was 18.5 seconds/5 μm.

Example 8

| | |
|---|---|
| Silver nitrate | 95 g/l |
| Dimethylhydantoin | 230 g/l |
| Sodium chloride | 50 g/l |
| pH | 10 |
| Liquid temperature | 70° C. |
| Current density | 60 A/dm$^2$ |

A copper test piece was subjected to high-speed silver plating using the above bath composition and working conditions, thereby obtaining a deposit having a film thickness of 5 μm and a dull appearance. The current efficiency was 100% and the plating speed was 9.5 seconds/5 μm.

Example 9

| | |
|---|---|
| Silver nitrate | 95 g/l |
| Dimethylhydantoin | 230 g/l |
| Potassium chloride | 40 g/l |
| Thiosalicyclic acid | 2 g/l |
| pH | 10 |
| Liquid temperature | 70° C. |
| Current density | 40 A/dm$^2$ |

A copper test piece was subjected to high-speed silver plating using the above bath composition and working conditions, thereby obtaining a deposit having a film thickness of 5 μm and a semi-glossy or glossy appearance. The current efficiency was 100% and the plating speed was 13.8 seconds/5 μm.

Example 10

| | |
|---|---|
| Silver nitrate | 1.6 g/l |
| Dimethylhydantoin | 70 g/l |
| Potassium chloride | 7 g/l |
| pH | 9.5 |
| Liquid temperature | 30° C. |
| Current density | 7 A/dm$^2$ (voltage 6 V) |
| Time | 20 seconds |

A copper test piece was subjected to silver strike plating using the above bath composition and working conditions, thereby obtaining a deposit having very good adhesion. After completion of the silver strike plating, silver plating was effected using the composition and working conditions of Example 3, by which a deposit having good adhesion was formed.

It was found that the deposits of Examples 1 to 10 were provided with the same satisfactory properties as those deposits obtained from cyanide baths with respect to hardness, adhesion, uniformity of electrodeposition, heat resistance, conductivity and the like.

The silver plating bath, high-speed plating bath and silver strike plating bath of the invention and the silver plating methods using these baths have the following common features. Since any toxic cyanide compound is not used, they are advantageous in safety and hygienic aspects. A thick plating having a thickness of not smaller than 50 μm is possible without use of any cyanide compound. Moreover, the use of hydantoin compounds as a complex-forming agent is better in cost than silver iodide-organic acid baths. In addition, plated articles obtained in the present invention exhibit the same quality as the case using cyanide baths with respect to the stability of bath, uniformity of electrodeposition, critical current density, physical properties of deposit and appearance. This does not depend on the bath temperature, with a deposition efficiency being 100%. The plating baths may be stably used by three turns or over.

Aside from the above common features, the silver plating bath, high-speed silver plating bath and silver strike plating bath and silver plating methods using the baths according to the invention have, respectively, the following features. With the silver plating bath of the invention wherein a gloss controlling agent is employed, a good appearance suitable for decoration is steadily obtained. The high-speed silver plating bath of the invention can remarkably improve the plating speed and has thus the possibility of application in wider fields including those in the electronic industry. The silver strike plating bath of the invention enables one to carry out silver plating as having better adhesion.

What is claimed is:

1. A silver electroplating bath consisting of at least one inorganic acid salt of silver used as a silver compound, at least one hydantoin compound of the following formula used as a complex-forming agent

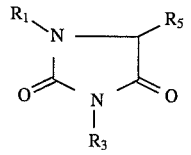

wherein $R_1$, $R_3$ and $R_5$ each independently represent hydrogen, an alkyl group having 1–5 carbon atoms, an aryl group or an alcohol, and

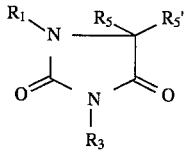

wherein $R_1$, $R_3$, $R_5$ and $R_5'$ each independently represent hydrogen, an alkyl group having 1–5 carbon atoms, an aryl group or an alcohol, and at least one of a salt of an inorganic acid and a carboxylate as a conductive salt said bath optionally containing a gloss controlling agent.

2. The silver electroplating bath according to claim 1, wherein said at least one inorganic acid salt of silver used as a silver compound is silver nitrate, silver oxide, or mixtures thereof.

3. The silver electroplating bath according to claim 1, wherein said complex-forming agent is at least one of 1-methylhydantoin, 1,3-dimethylhydantoin, 5,5-dimethylhydantoin, 1-methanol-5,5-dimethylhydantoin, and 5,5-diphenylhydantoin.

4. The silver electroplating bath according to claim 1, wherein at least one of an organic sulfur compound having a SH group or a carboxyl group, a S-containing amino acid, or sulfite ions is introduced as a gloss controlling agent.

5. The silver electroplating bath according to claim 1, wherein potassium chloride, potassium formate, or mixtures thereof is introduced as the conductive salt.

6. The silver electroplating bath according to claim 1, wherein said silver is contained in an amount of 1–100 g/l as a metal concentration, said complex-forming agent is contained in an amount of $10^{-15}$–$10^{-2}$ mol/l as a concentration of silver ions in the bath, and said conductive salt is contained in an amount of 1–100 g/l.

7. A silver electroplating method wherein said silver plating bath according to claim 1 is employed under working conditions of a pH of 8–13, a liquid temperature of 30°–90° C. and a current density of 1–20 A/dm$^2$.

8. A high-speed silver electroplating bath consisting of the bath composition of claim 1.

9. The high-speed silver electroplating bath according to claim 8, wherein said silver is contained in an amount of 1–150 g/l as a metal concentration, said complex-forming agent is contained in an amount of $10^{-15}$–$10^{-2}$ mol/l as a concentration of silver ions in the bath, and said conductive salt is contained in an amount of 1–100 g/l.

10. A high-speed silver electroplating method wherein the high-speed silver plating bath according to claim 9 is employed under working conditions of a pH of 8–13, a liquid temperature of 30°–90° C. and a current density of 10–150 A/dm$^2$.

11. A high-speed silver electroplating method wherein said high-speed silver plating bath according to claim 8 is employed under working conditions of a pH of 8–13, a liquid temperature of 30°–90° C. and a current density of 10–150 A/dm$^2$.

12. A silver strike electroplating bath consisting of the bath composition of claim 1.

13. A silver strike electroplating bath according to claim 12, wherein said silver is contained in an amount of 0.1–5 g/l as a metal concentration, said complex-forming agent is contained in an amount of $10^{-15}$–$10^{-2}$ mol/l as a concentration of silver ions in the bath, and said conductive salt is contained in a amount of 1–100 g/l.

14. A silver strike electroplating method wherein said silver strike plating bath according to claim 13 is employed under working conditions of a pH of 7–13, a liquid temperature of 20°–90° C. and a current density of 1–20 A/dm$^2$ or a voltage of 1–20 V.

15. A silver strike electroplating method wherein said silver strike plating bath according to claim 12 is employed under working conditions of a pH of 7–13, a liquid temperature of 20°–90° C. and a current density of 1–20 A/dm$^2$ or a voltage of 1–20 V.

* * * * *